US011523644B2

(12) United States Patent
Hall et al.

(10) Patent No.: US 11,523,644 B2
(45) Date of Patent: Dec. 13, 2022

(54) INFLATABLE GARMENT WITH LIGHTWEIGHT AIR PUMP AND METHOD OF USE

(71) Applicant: NuDown, Inc., Reno, NV (US)

(72) Inventors: Robert Hall, Reno, NV (US); Cory Tholl, Kaysville, UT (US); Matt Maxfield, Reno, NV (US)

(73) Assignee: NuDown, Inc., Reno, NV (US)

( * ) Notice: Subject to any disclaimer, the term of this patent is extended or adjusted under 35 U.S.C. 154(b) by 1033 days.

(21) Appl. No.: 15/487,203

(22) Filed: Apr. 13, 2017

(65) Prior Publication Data

US 2017/0295860 A1 Oct. 19, 2017

Related U.S. Application Data

(60) Provisional application No. 62/322,110, filed on Apr. 13, 2016.

(51) Int. Cl.

| | |
|---|---|
| ***A41D 13/002*** | (2006.01) |
| ***A41D 1/04*** | (2006.01) |
| ***A41D 3/00*** | (2006.01) |
| ***A41D 27/20*** | (2006.01) |
| ***A41B 1/08*** | (2006.01) |
| ***A41D 27/10*** | (2006.01) |
| ***F04B 33/00*** | (2006.01) |
| ***F04B 45/00*** | (2006.01) |

(52) U.S. Cl.

CPC ..... *A41D 13/002* (2013.01); *A41B 1/08* (2013.01); *A41D 1/04* (2013.01); *A41D 3/00* (2013.01); *A41D 27/10* (2013.01); *A41D 27/20* (2013.01); *F04B 33/00* (2013.01); *F04B 45/00* (2013.01); *A41D 2400/14* (2013.01)

(58) Field of Classification Search

CPC ..... A41D 13/002; A41D 1/04; A41D 3/00; A41D 27/10; A41D 2400/14; A41D 13/0058; A41D 13/0051; A41D 31/06; A41B 1/08; F04B 3/00; F04B 45/00

See application file for complete search history.

(56) References Cited

U.S. PATENT DOCUMENTS

| | | | | |
|---|---|---|---|---|
| 1,468,072 A * | 9/1923 | Ogle | A47C 7/021 128/889 |
| 3,771,170 A | 11/1973 | Leon | |
| 4,242,769 A | 1/1981 | Rayfield et al. | |
| 4,370,754 A * | 2/1983 | Donzis | A41D 13/0153 2/16 |
| 4,416,641 A * | 11/1983 | Spinosa | A41D 13/0125 441/107 |

(Continued)

OTHER PUBLICATIONS

Marc Perton, Airvantage vest uses your breath as insulation, Engadget, Aug. 29, 2005.

(Continued)

*Primary Examiner* — Jameson D Collier

(74) *Attorney, Agent, or Firm* — Holland & Hart LLP

(57) ABSTRACT

An inflatable cold-weather upper-body garment. The garment includes first and second pluralities of interconnected gas flow chambers, each plurality enclosed by gas-impermeable material; a fluid-flow channel connecting the first and second pluralities of gas flow chambers; and a hand-operable air pump in fluid communication with one of the gas flow chambers.

39 Claims, 10 Drawing Sheets

(56) References Cited

U.S. PATENT DOCUMENTS 4,547,906 A 10/1985 Nishida et al.
4,620,380 A 11/1986 Aldinio
4,631,843 A 12/1986 Annovi
4,646,366 A 3/1987 Nishida et al.
4,730,403 A 5/1988 Walkhoff
5,113,599 A 5/1992 Cohen et al.
5,303,425 A * 4/1994 Mele ..... A41D 13/0053 2/102
5,433,083 A 7/1995 Kuramarohit
5,480,287 A 1/1996 Pozzebon et al.
5,537,688 A 7/1996 Reynolds et al.
5,867,842 A 2/1999 Pinsley et al.
5,970,519 A 10/1999 Weber
5,987,779 A 11/1999 Litchfieled et al.
6,151,735 A * 11/2000 Koby ..... A47G 9/1027 5/644
6,564,387 B1 * 5/2003 Willoughby ..... A41D 13/0537 2/69
6,655,050 B1 12/2003 Lowe
6,910,235 B2 6/2005 Lack et al.
7,351,126 B2 * 4/2008 Turner ..... B63C 9/087 441/103
7,707,650 B2 * 5/2010 Sides ..... A41D 13/0537 2/69
7,879,069 B2 2/2011 Lee
8,393,013 B2 * 3/2013 Bowen ..... A41D 15/04 2/69
2002/0157165 A1 * 10/2002 Kroll ..... A41D 13/0125 2/69
2004/0040087 A1 * 3/2004 Lack ..... A47G 9/0207 5/413 AM
2005/0168681 A1 * 8/2005 Kroll ..... A41D 13/0125 351/44
2006/0144557 A1 * 7/2006 Koscheyev ..... F28F 21/06 165/46
2008/0249276 A1 10/2008 Alder et al.
2010/0083417 A1 4/2010 Alder et al.
2011/0072565 A1 * 3/2011 Krueger ..... A41D 13/0151 2/459
2011/0107521 A1 5/2011 Alder et al.
2012/0037269 A1 * 2/2012 Alder ..... B32B 27/00 141/98
2013/0174311 A1 * 7/2013 Oliver ..... B64D 10/00 2/2.14
2014/0012171 A1 * 1/2014 Brown ..... A61F 5/01 602/13
2014/0201884 A1 7/2014 Alder et al.
2016/0021839 A1 * 1/2016 Blahnik ..... B05B 7/1486 239/71
2017/0181482 A1 * 6/2017 Bruce ..... A41D 27/28
2017/0295860 A1 * 10/2017 Hall ..... A41D 13/002
2018/0116308 A1 * 5/2018 Kopes ..... A41D 15/04
2019/0060164 A1 * 2/2019 Vo ..... A61H 39/04
2019/0061889 A1 * 2/2019 Cardi ..... B63C 9/155

OTHER PUBLICATIONS

International Search Report and Written Opinion of The International Searching Authority for International Application PCT/US17/27468, dated Aug. 22, 2017.
Andrew Lasane; Innovative Jacket Allows You to Add Insulation With Built-In Pump; Jan. 16, 2016.
Exped Mini Pump; Mar. 29, 2010.
Nudown; Adjustable, Air-Inflation Insulation Technology; Nov. 6, 2015.

* cited by examiner

INFLATABLE GARMENT WITH LIGHTWEIGHT AIR PUMP AND METHOD OF USE

CROSS-REFERENCE TO RELATED APPLICATIONS

This application claims priority from U. S. Provisional Application Ser. No. 62/322,110 filed Apr. 13, 2016, the entire contents of which are incorporated herein by this reference.

BACKGROUND

This invention is in the field of thermally-insulating material. More particularly this invention relates to material that can be filled with thermally-insulating gas and to portable gas reservoirs and valve mechanisms for introducing gas into such material.

Thermal insulators have long been important for human survival and comfort in cold climates. The primary function of any thermal insulator is to reduce heat loss (that is, heat transfer from a heat source to a cold sink). Heat transfer can occur by convection, conduction, and radiation.

Heat loss through convective mixing of gases is caused by the tendency of a gas to form a rotational mixing pattern between a warmer (less dense) region and a cooler (more dense) region. In a convection cycle, warmer gas is constantly being exchanged for cooler gas. One of the primary ways thermal insulators work is by suppressing such convection by trapping or confining a volume of a gas within thermally-insulating material. For example, one reason a fiber-filled parka feels warm is that the air near the wearer's skin is warmed by body heat, and the fibers prevent or at least slow convective mixing of the warmed layer of air with the cold air outside.

Conduction involves heat flow through a material from hot to cold in the form of direct interaction of atoms and molecules. For example, the phenomenon of conduction is one of the reasons why a thin layer of insulation does not insulate as well as a thicker layer.

Radiation involves direct energy transfer between surfaces at different temperatures through infrared radiation. Such radiation can be suppressed by using infrared-reflective materials. For example, a glass surface of a vacuum flask is coated with silver to reflect infrared and thereby prevent heat transfer through the vacuum space between the glass walls.

Different thermal insulators prevent heat loss through convection, conduction, and radiation in different ways. For example, fiber-based thermal insulators like polyester fiber fill or fiberglass insulation use fibers of low thermal conductivity in a stack or batt with a volume of air trapped or confined amongst the fibers, thereby reducing convective heat transfer. Conduction is reduced by random orientation of the fibers across the stack or batt, and radiative heat loss is reduced because the radiation is scattered as it passes through the fibers.

A closed-cell structure such as foam or microsphere is another example of a thermal insulator. Closed-cell structures usually comprise a polymer matrix with many small, mostly closed cavities. As with fiber-based insulations, these insulators conserve heat by trapping a volume of air in and amongst the cells. In fact, convection is effectively eliminated inside the small, closed cells. Furthermore, conduction is reduced by using low conductivity materials, and radiation is low because the cells are typically very small and there is little temperature difference between cavity walls and hence low driving force for radiative heat transfer.

Thermal insulators present a tradeoff between effectiveness of insulation, bulk, and cost. For example, because of the bulkiness of fiber- or foam-based insulation, achieving a sufficient degree of insulation for a given set of conditions can be difficult without also making the article too bulky for practical use. Adding more fiber- or foam-based insulation inevitably adds weight. Such insulators are static in that the amount of insulation cannot be changed or adjusted as the user's needs change. For example, if a person is wearing a fiber-filled parka, or sleeping in a fiber filled sleeping bag, the amount of insulation cannot be increased or decreased as environmental conditions change or as the user's level of activity increases or decreases.

Also, processes of manufacturing many thermally-insulating materials produce toxic or environmentally damaging byproducts. For example, the manufacturing process for many thermal insulators such as polyester fibers or foams produces CFCs or greenhouse gases. Even worse, these thermal insulators continue to emit toxic chemicals long after their manufacture. For example, fiberglass insulation is typically manufactured with formaldehyde compounds that continue to outgas long after the insulation is placed in a wall or other structure. And many typical insulators, such as fiberglass or polyester fiber fill, produce loose fibers that can be harmful if they are inhaled.

SUMMARY

The inventors believe they have discovered one or more of the disadvantages of thermally-insulating materials as briefly described above and a variety of novel aspects of thermally-insulating clothing that address these disadvantages and other features that may be utilized in other applications.

Briefly and in general terms, in one aspect an upper garment such as an inflatable jacket, vest, or shirt has one or more inflatable sections on its front side. In some embodiments, a plurality of such inflatable sections are interconnected by one or more inflatable air channels. These inflatable air channels in some instances extend across the back of the upper garment. One or more of the inflatable air channels may be adjacent or part of a neck-surrounding portion of the upper garment.

Some embodiments provide a small, lightweight, soft air pump that may comprise a compressible and expandable interior material having collapsible and expandable cavities through which air may be retained or expelled from the interior of the pump. For example, the interior material may be similar to a sponge. In its original (expanded) configuration, air fills the cavities, and when pressure is applied to compress the interior material, air is ejected from cavities into inflatable sections of the upper garment.

In some applications, a soft flexible container (sack) may surround or contain the interior material. This container may be made of relatively non-permeable fabric or other material such as a thin sheet of plastic. Compressing the container also compresses the interior material, pumping air out of the container.

In some instances, the container may have an opening, providing an air channel for air to pass into or out of the interior of the container. The opening may be located so that the a user can cover the opening with a portion of the hand, such as a finger for example, in order to cover the opening and prevent air from escaping the container during compression of the pump. The opening may thus provide a channel for air to enter the interior of the container when the user no longer block the opening.

In some embodiments, the container is connected to an air supply line that may have one or more sections, valves, control structures, and the like.

The container may located in differing locations on or within the garment, such as removably mounted within a conventional hand pocket or other pocket such as on an arm or adjacent a lower edge on the front side of the jacket. Differing locations can provide differing advantages such as explained in greater detail infra.

Other aspects will become apparent from the following exemplary description and drawings.

BRIEF DESCRIPTION OF THE DRAWINGS

The preferred and other embodiments are disclosed in association with the following exemplary Figures and related Detailed Description.

DETAILED DESCRIPTION

Figure 1:
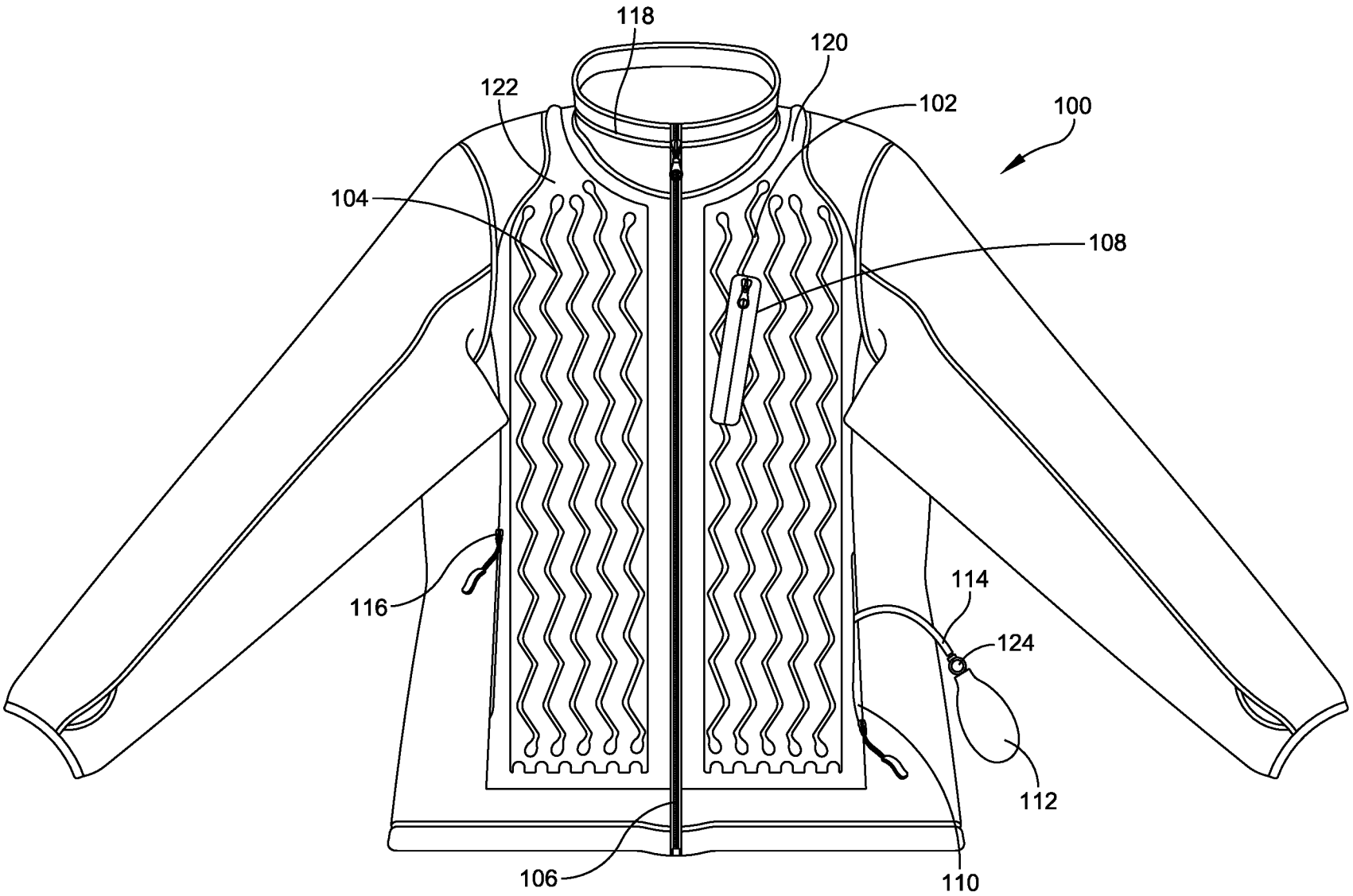
FIG. 1 is a front perspective view of an embodiment of an inflatable jacket with a hand pump.

FIG. 1 shows an embodiment of an inflatable jacket generally 100. The jacket includes left and right inflatable sections 102 and 104. A zipper 106 intermediate the left and right inflatable sections may be used to open and close the jacket. The left inflatable section 102 includes a utility pocket 108; this pocket may be omitted and other utility pockets may be provided as desired. The left inflatable section 102 includes a side pocket 110 sized to contain a hand pump 112 that can be removed from within the pocket 110 and hand-squeezed to inject air through an air tube 114 into the left inflatable section 102.

In some embodiments the right inflatable section 104 includes a side pocket 116. The side pocket 116 may contain a hand pump (not shown), similar to the hand pump 112, for inflating the right inflatable section 104; in the embodiment shown, the side pocket 116 may be omitted or may serve as a utility pocket because only one pump is used for the entire garment.

The jacket 100 includes a neck section 118. In some embodiments an upper extremity 120 of the left inflatable section 102 extends around a left side of the neck section 118. Similarly, an upper extremity 122 of the right inflatable section 104 extends around a right side of the neck section 118.

An air release valve 124 may be provided, for example in the air tube 114 or as part of the hand pump 112. A user can operate the valve to release air from the inflatable sections.

Figure 2:
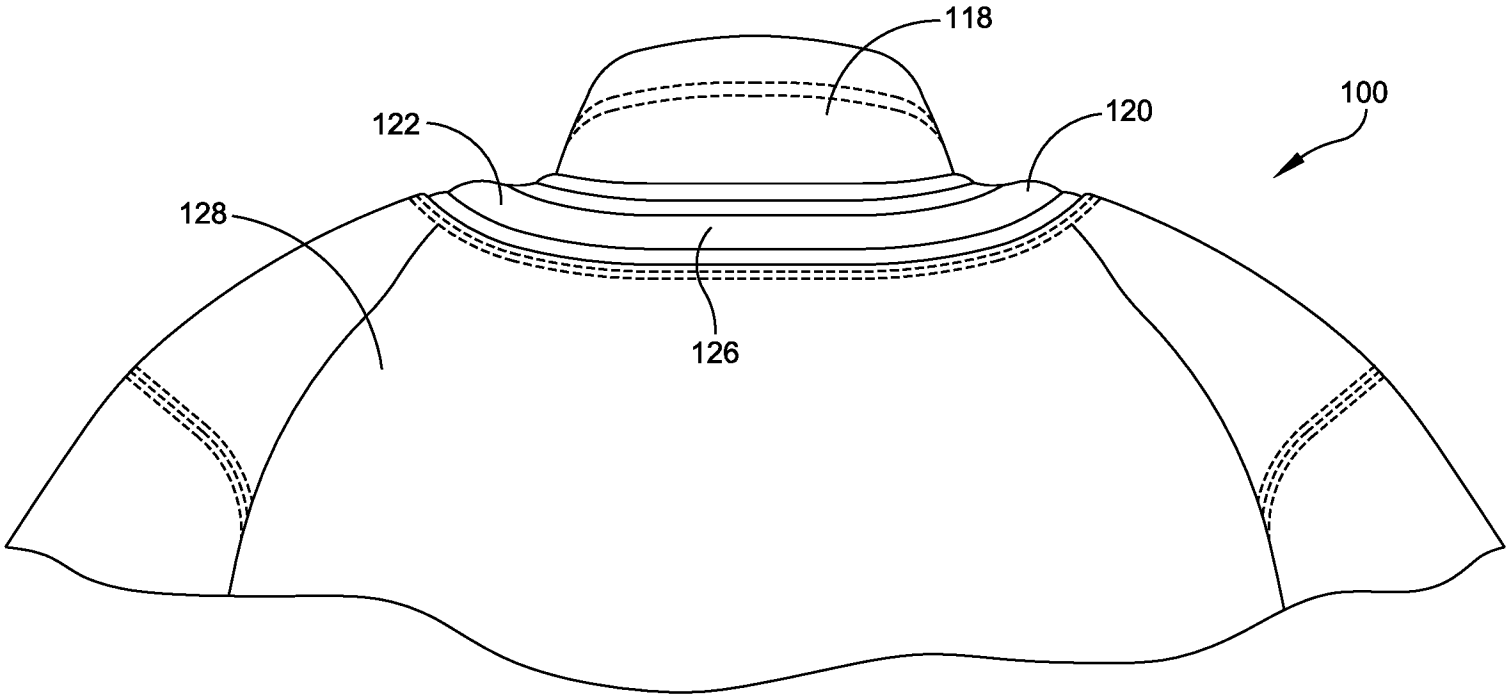
FIG. 2 is a perspective view of the backside of the upper portion of the jacket shown in FIG. 1.

Referring now to FIG. 2, the upper extremities 120 and 122 connect to define a bidirectional air channel 126 between the left and right inflatable sections 102 and 104 across the back side 128 of the jacket 100.

In some embodiments the back side 128 may also include one or more inflatable sections that may be interconnected by air channels similar to the air channel 126 formed by the extremities 120 and 122 of the left and right inflatable sections 102 and 104. In the embodiment shown, the back side 128 does not include inflatable sections.

Figure 3:
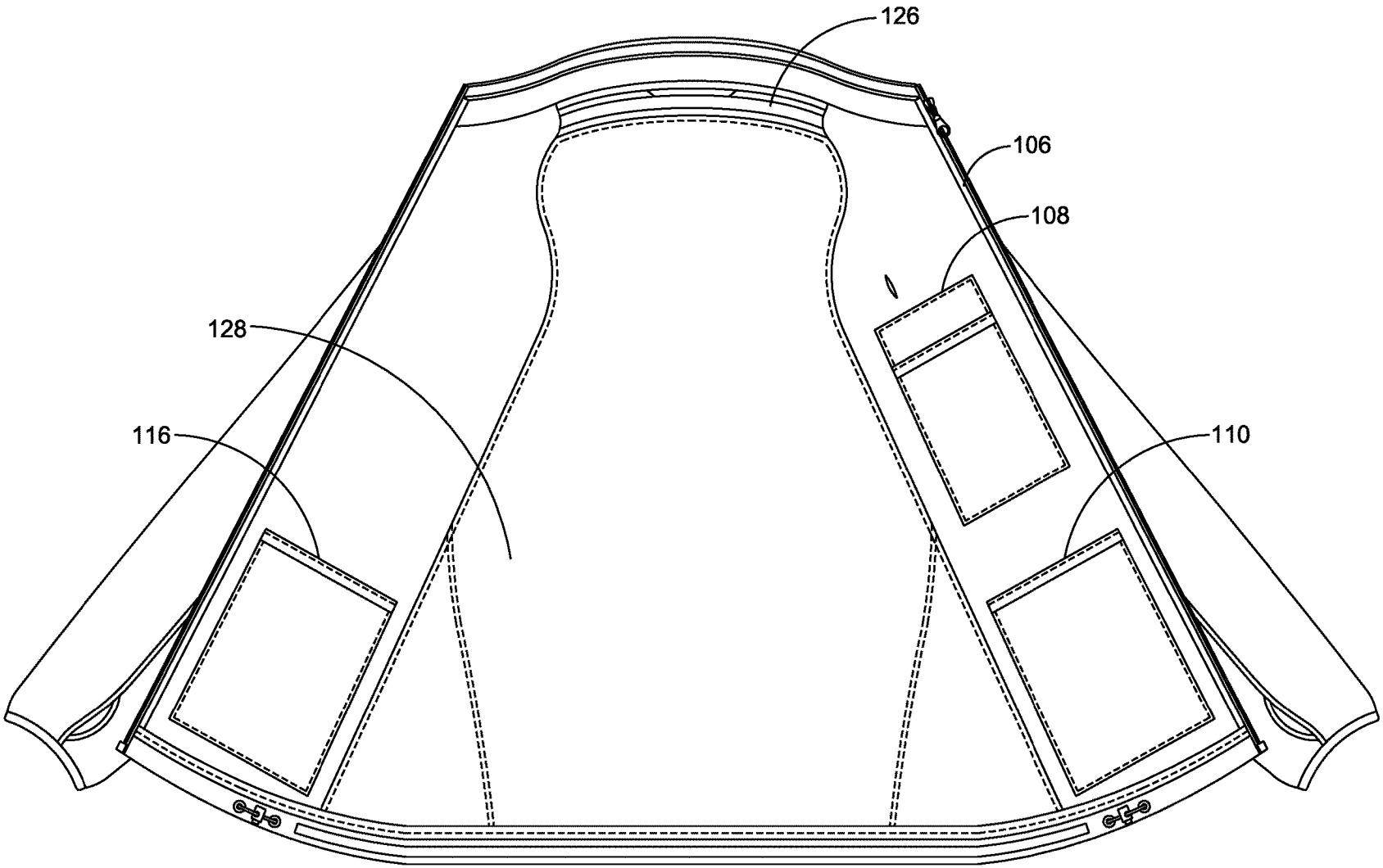
FIG. 3 is a perspective view of the interior of the jacket shown in FIG. 1.

FIG. 3 shows the air channel 126 as seen from the front when the zipper 106 has been unzipped and the jacket 100 opened; in some embodiments the channel 126 may be concealed in the fabric of the jacket. The pump 112 and air tube 114 are omitted from this view for clarity.

Figure 4:
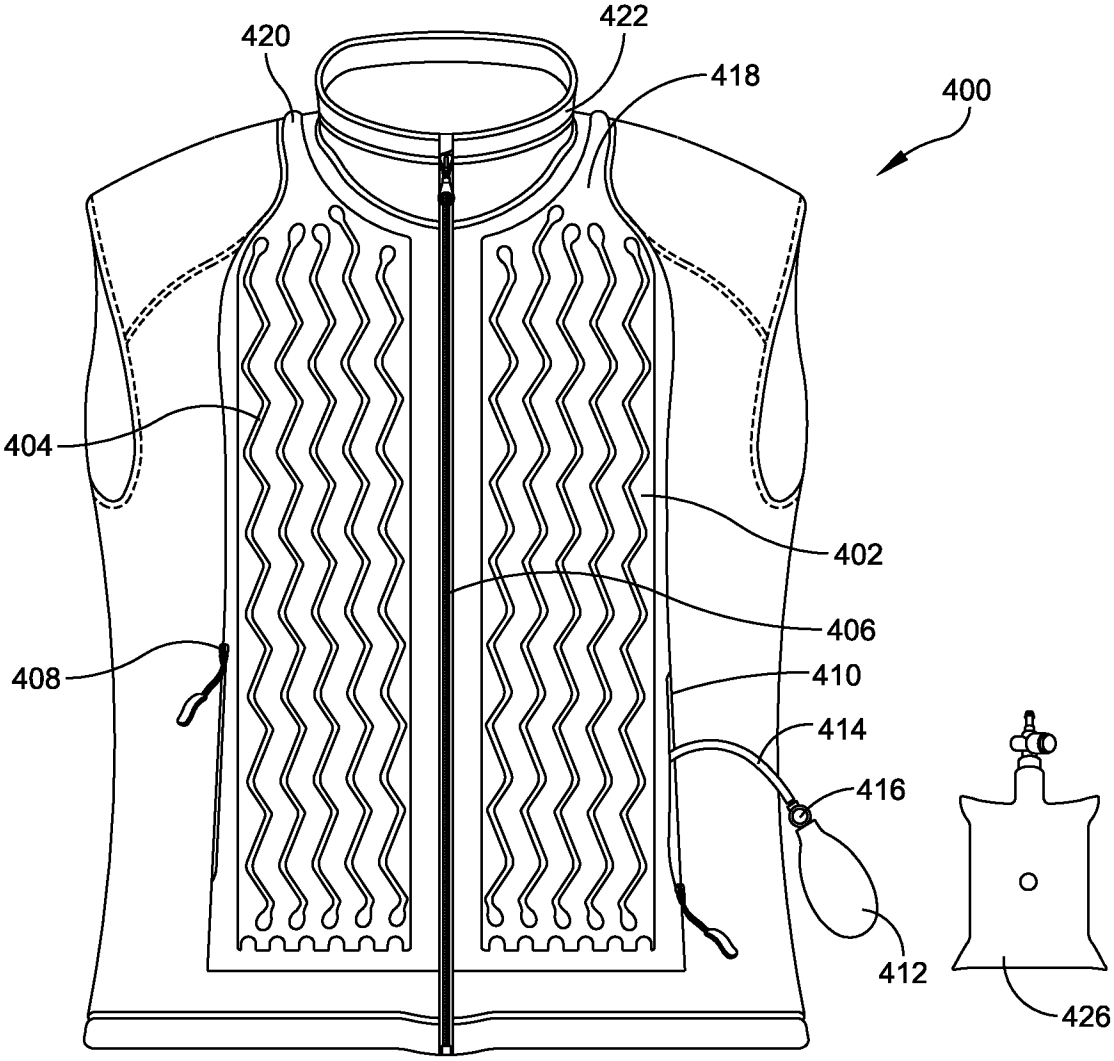
FIG. 4 is a front perspective view of an embodiment of an inflatable vest with a hand pump and an optional soft pump.
Figure 5:
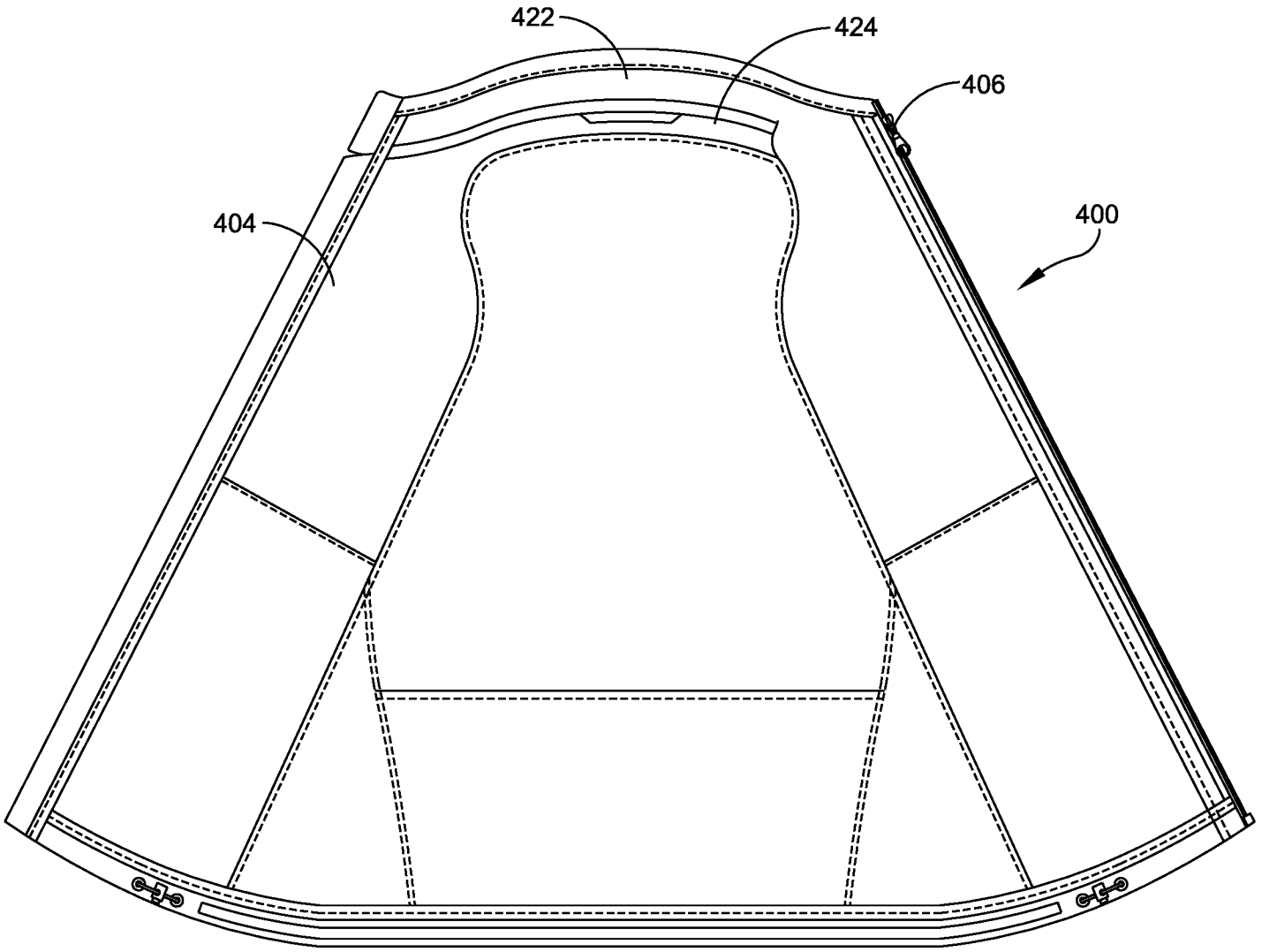
FIG. 5 is a perspective view of the interior of the vest shown in FIG. 4.

FIGS. 4 and 5 show an inflatable vest generally 400 that is similar to the inflatable jacket 100 except that it has no sleeves. The vest 400 includes left and right side inflatable sections 402 and 404. A zipper 406 intermediate the first and second inflatable sections may be used to open and close the vest. The vest may include one or more utility pockets such as a pocket 408 in the right inflatable section 404. The left inflatable section 402 includes a side pocket 410 sized to contain a hand pump 412 that can be removed from within the pocket 410 and hand-squeezed to inject air through an air tube 414 into the left inflatable section 402. A user-operable air release valve 416 may be provided in the air tube 414 or in the hand pump 412. An extremity 418 of the left inflatable section 402, and an extremity 420 of the right inflatable section 404, extend around left and right sides of a neck section 422 and connect to define an air channel 424 between the left and right inflatable sections.

Figure 6:
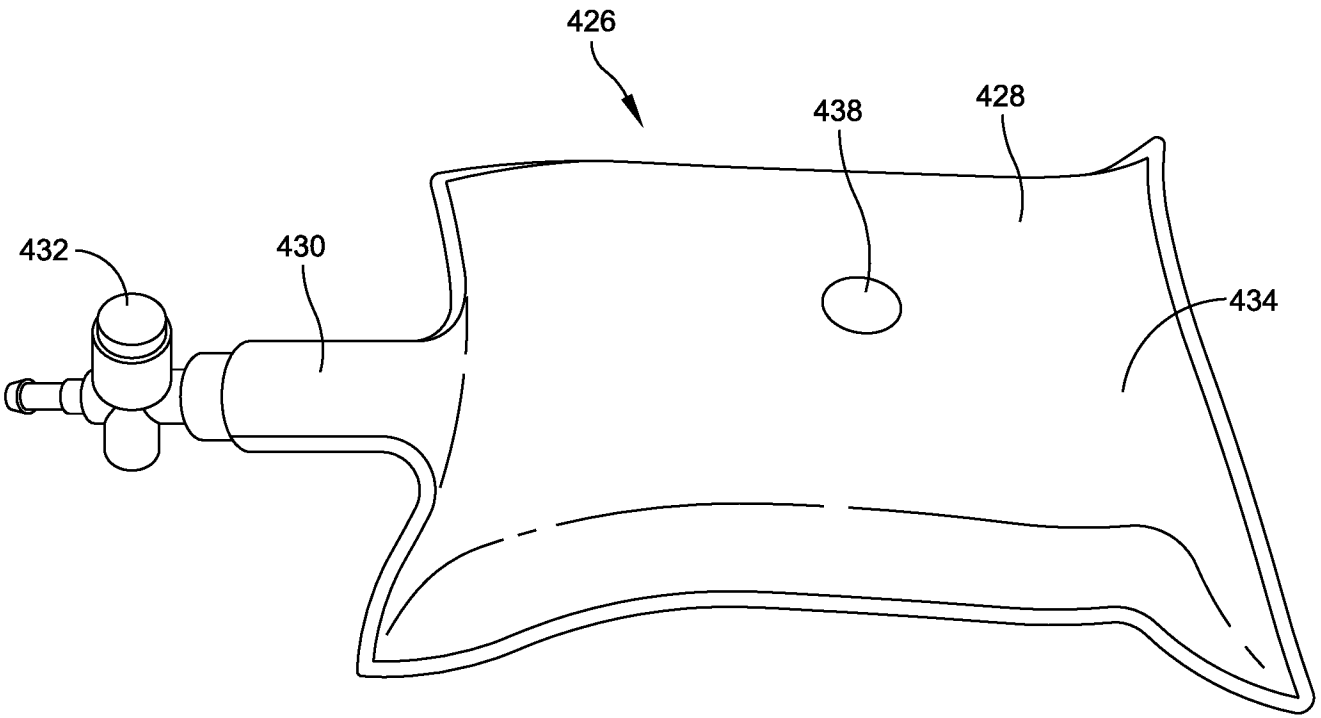
FIG. 6 is a perspective view of a front side of the optional soft pump shown in FIG. 4.
Figure 7:
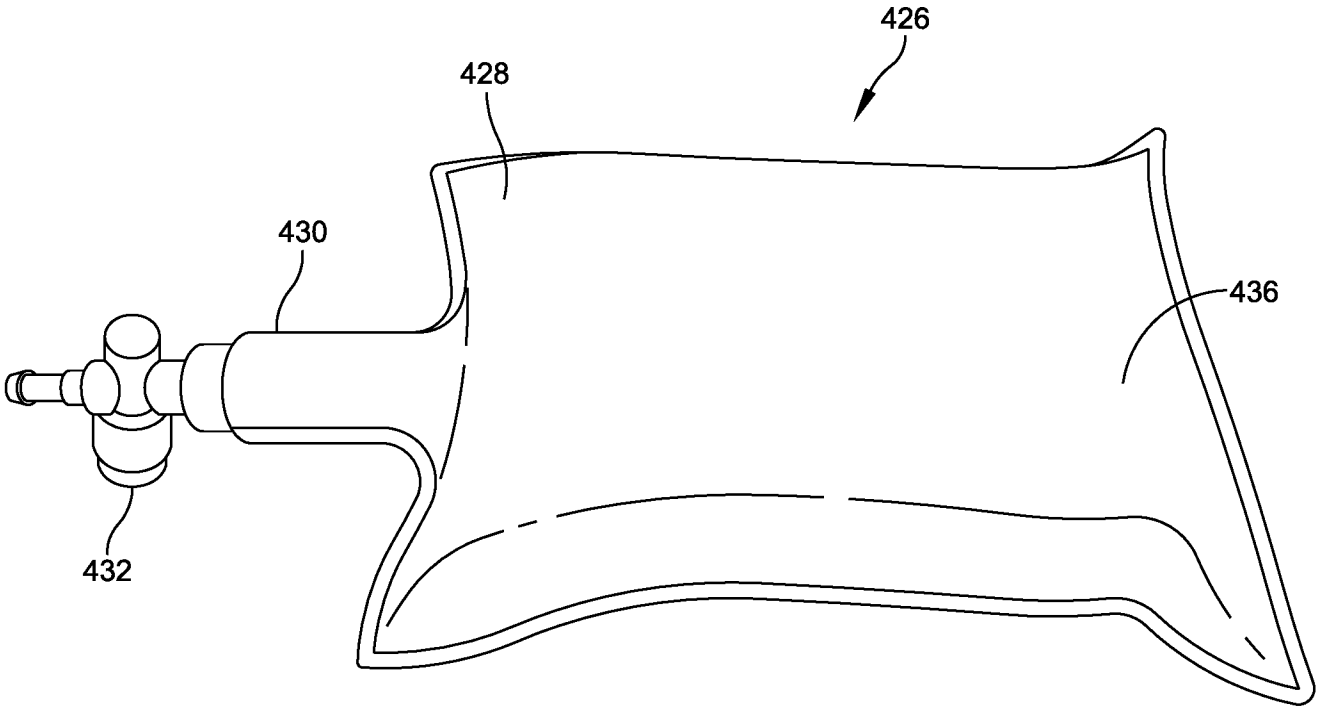
FIG. 7 is a perspective view of a back side of the optional soft pump of FIG. 4.

FIG. 4 also shows a soft air pump 426 that can be substituted for the hand pump 412 and connected to the air tube 414. FIGS. 6 and 7 show the soft air pump 426 in more detail. A compressible and expandable interior material (not visible in the figures) having collapsible and expandable cavities through which air may be retained and expelled (for example, a sponge or sponge-like material) is contained in a resilient, flexible, gas-impermeable sack 428. The sack may be made of fabric such as nylon, polypropylene, cotton, rayon, spandex, or the like; thin flexible plastic; or other suitable material.

An air delivery channel 430 extends from the sack 428. A user-operable air release valve 432 may be provided in the air delivery channel 430 to enable the user to release air from the garment as desired. The valve 432 may also be configured as a one-way valve to prevent air from flowing back into the sack 428 from the garment. The air delivery channel 430 is connectable to an air tube such as the air tube 114 in FIG. 1 or the air tube 414 in FIG. 4.

The sack 428 has first and second sides 434 and 436. The first side 434 of the sack 428 may have an air inlet 438 such as a finger-sized opening (between about 0.5 and 1.5 centimeters in diameter). A user may close the air inlet 438 by placing a finger tightly over it while applying hand pressure to the sack as a whole, for example by squeezing. When the air inlet 438 is closed and the sack 428 is squeezed, air is expelled from the material in the sack through the air delivery channel 430 and thence into the inflatable sections of the garment. When the user releases pressure on the sack and uncovers the air inlet 438, ambient air flows through the air inlet 438 into the material in the sack 428.

In some embodiments the soft air pump has dimensions of about 9 to 15 centimeters long by about 6 to 10 centimeters wide by about 1 to 2.5 centimeters thick. The soft air pump may weigh about 25 to 150 grams. The air channel 424 that extends around the back of the neck may be about 2 to 3 millimeters in diameter, uninflated.

Figure 8:
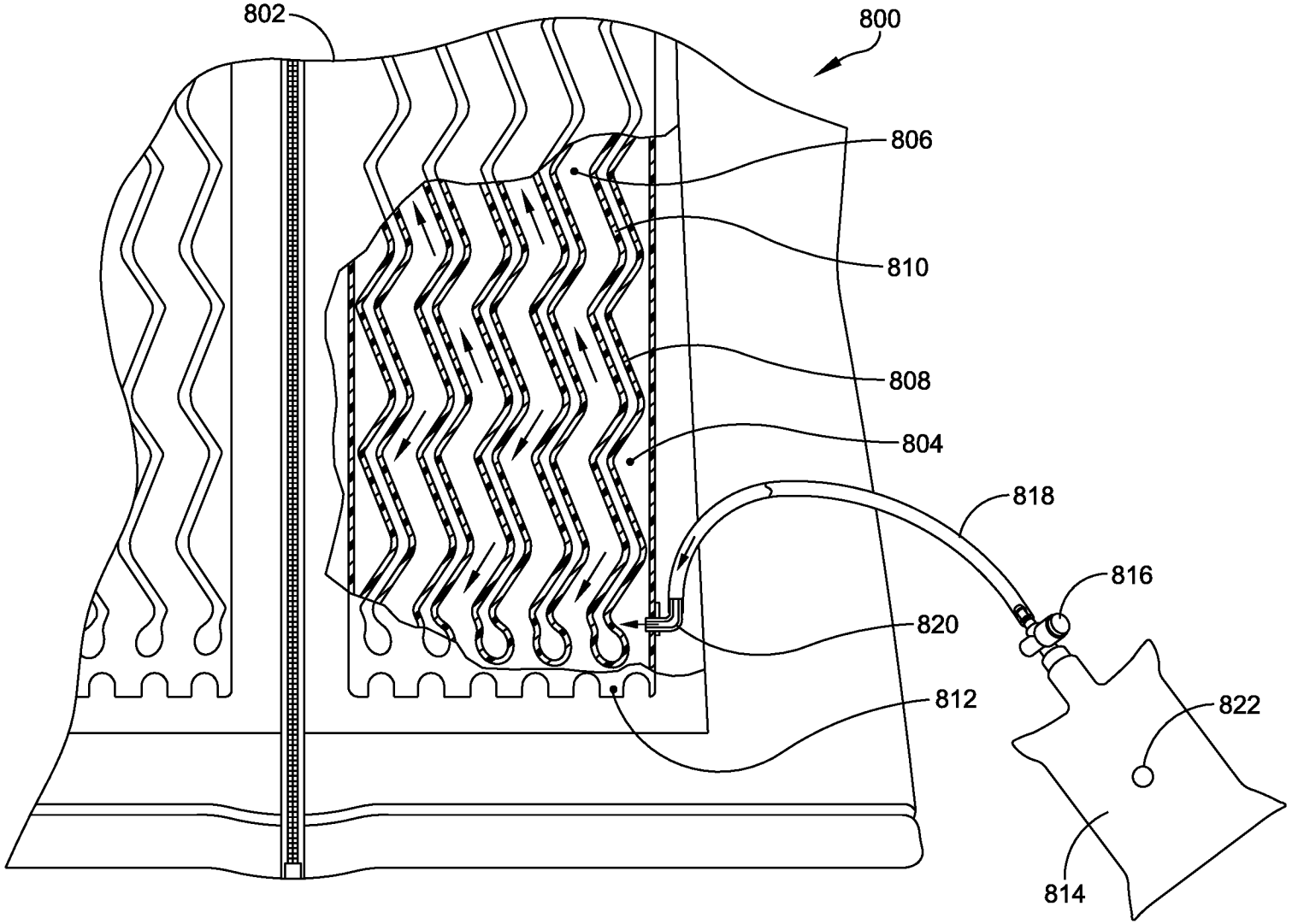
FIG. 8 is a partially-cutaway detail view of a portion of the inflatable vest of FIG. 4 with a soft pump connected to the inflatable vest.

FIG. 8 shows in cutaway view a detail of a portion of an inflatable garment 800 similar to the jacket and vest discussed above. A left side inflatable section 802 contains a plurality of interconnected air channels including a first air channel 804 and a second air channel 806 defined between ridges or seams 808 and 810. Other air channels are similarly defined between other seams or ridges. The air channels may be formed, for example, by stitching two layers of fabric together to form seams, or by disposing a flexible tubular material between two layers of fabric to form ridges, or the like. The air channels may be interconnected at any convenient places, for example at an area 812 adjacent lower extremities of the seams or ridges 808 and 810.

A soft pump 814 similar to the soft pump 426 is connected to the air channels through an air release valve 816, an air tube 818, and a fitting 820. The soft pump includes a user-controllable air inlet 822 which may be a finger-sized opening as described above.

Figure 9:
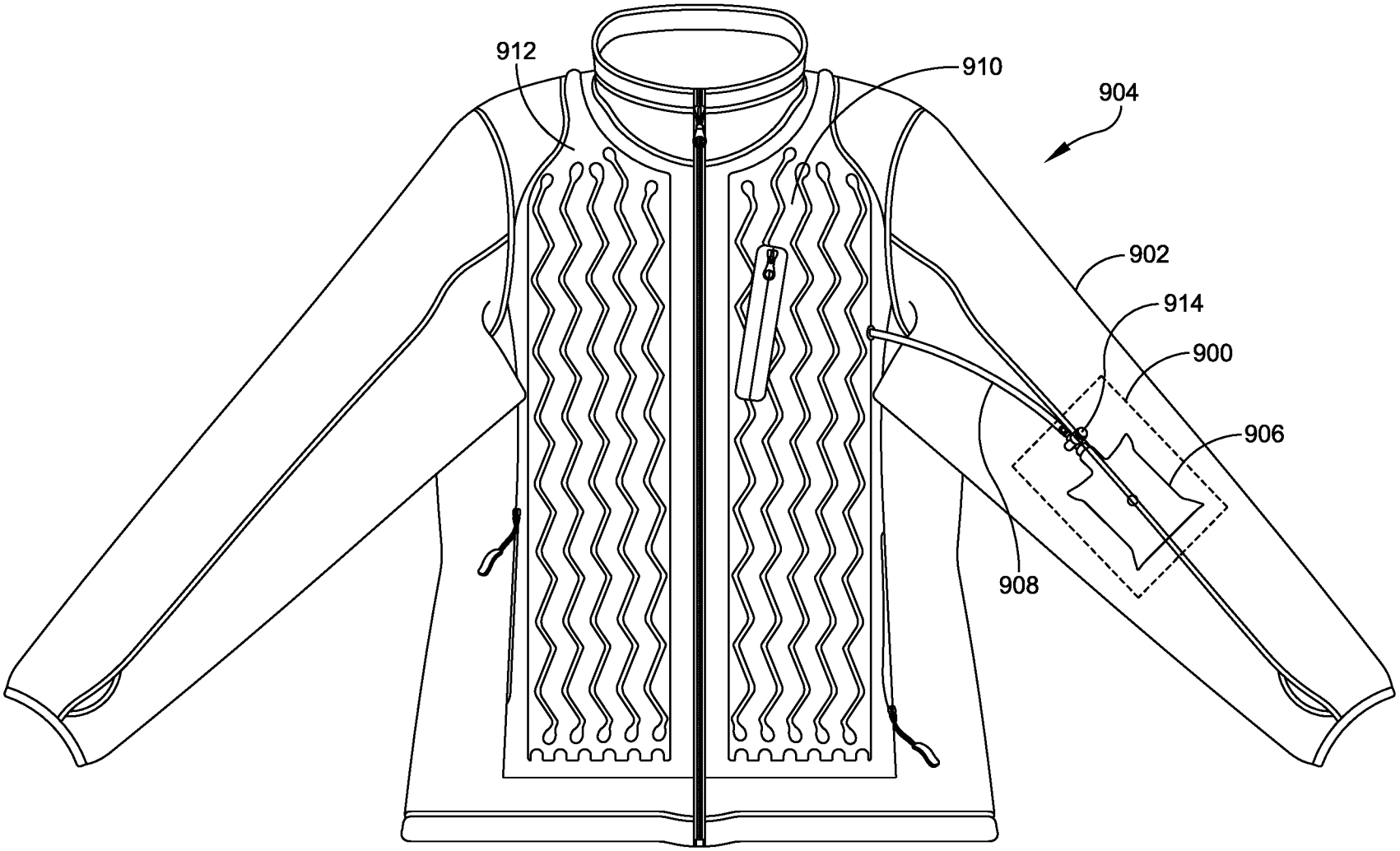
FIG. 9 is a front perspective and partially-cutaway view of another embodiment of an inflatable jacket with a soft pump disposed in an elbow area of the jacket.

A hand pump such as the pump 112 or the pump 412, or a soft air pump such as the pump 426 or the pump 814, may be mounted in any convenient location on or in the garment together with an air tube such as the tube 114 or the tube 414 and a release valve such as the valve 124 or the valve 416. For example, the pump may be placed in a location where a part of a user's body other than a hand may activate the pump. As shown in FIG. 9, one such location is at the front of an elbow-abutting portion 900 of a jacket sleeve 902 of a jacket 904. In this example a soft pump 906 is sewn or otherwise disposed inside the sleeve 902 adjacent the elbow-abutting portion 900 so that the pump can be repeatedly compressed by flexing the user's arm. Air is carried from the pump 906 through an air tube 908 to left and right inflatable sections 910 and 912 of the jacket 904. An air release valve 914 may be disposed at any convenient point between the pump 906 and the left inflatable section 910 for the user to release air pressure in the jacket.

In some embodiments these components may be disposed in a pocket or near the lower edge of the garment. The sack of a soft pump may be secured in such a position by stitching, buttons, VELCRO®, a type of hook and loop fastener, or other fastening means, so that the user may merely grasp the sack or, in some instances, the surrounding garment at that location, and repeatedly squeeze the sack to pump air into the garment.

Figure 10:
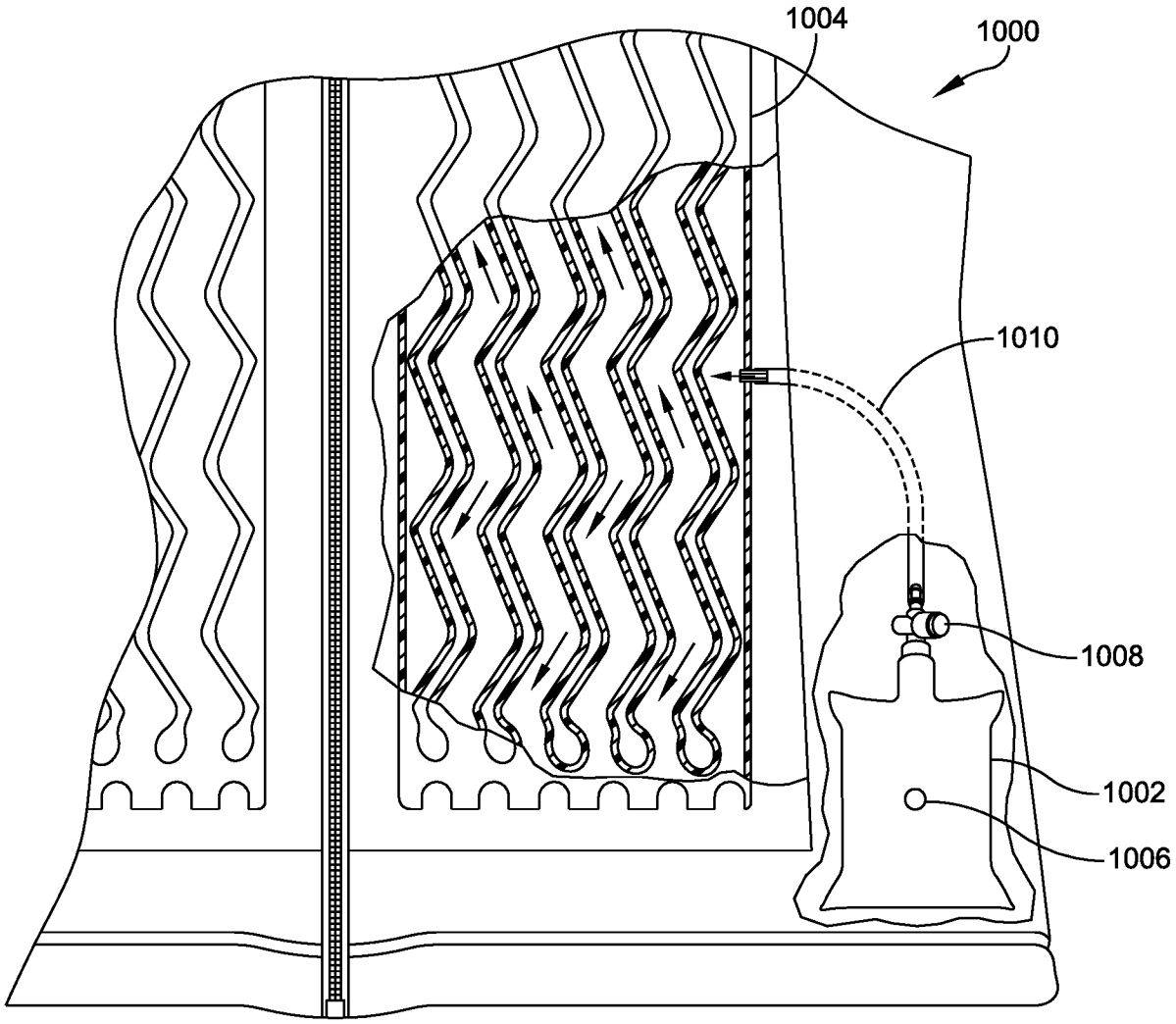
FIG. 10 is a partially-cutaway detail view of a portion of the inflatable vest of FIG. 4 with a soft pump disposed in a lower torso area of the inflatable vest.

FIG. 10 shows another embodiment of an inflatable garment 1000 that includes a soft pump 1002. In this embodiment the soft pump 1002 is disposed in the fabric of the garment 1000 adjacent a left inflatable section 1004. An air inlet 1006 comprises a finger-sized hole in the fabric through which air can be admitted to the soft pump 1002; a cover may be provided to prevent moisture from entering the pump 1002 when the pump is not being used.

A simple flapper valve (not shown may be used to provide a one-way passage for air to flow from the pump 1002 into the garment 1000 when the air inlet 1006 is covered by a finger and the pump 1002 is squeezed. The flapper valve prevents backflow of air from the garment back into the pump 1002 when pressure is released; instead, when pressure on the pump 1002 is released, the pump fills with air drawn in through the air inlet 1006. The flapper valve may be included in a user-operable air release valve 1008 such that the user can release air from the garment by manually operating the air release valve and that the air release valve prevents air from leaving the garment except when the user operates the valve.

The soft pump 1002 may be located in any convenient part of the garment 1000. Depending on where the pump is located, the use may be able to inflate the garment by pressing a hand against the garment adjacent the sack, or squeezing an arm against a side of the garment, or the like. The soft pump 1002 may be connected to an inflatable section such as the left section 1004 of the garment through an air tube 1010, or the soft pump 1002 may connect directly to the inflatable section or even be disposed inside the inflatable section, eliminating any need for an air tube.

Any of the foregoing garments may be fabricated from any suitable fabric such as rayon, nylon, polyester, spandex, KEVLAR®, a type of para-aramid fiber, laminated KEVLAR®, or the like. Portions of the fabric that enclose the interconnected air channels may be bonded to a gas-impermeable material such as polyethylene, polypropylene, urethane, polyurethane, rubber, silicone rubber, latex rubber, butylrubber, MYLAR®, a type of "biaxially-oriented polyethylene terephephthalate," polytetrafluoroethylene (PTFE), expanded PTFE, or the like.

Two sheets of gas-impermeable material may be joined together to form the interconnected air channels by such techniques as ultrasonic welding, laser welding, stamp heat welding, hot plate welding, gluing, taping, sewing, weaving, or one-piece weaving in a manner similar to that used to form airbags.

In some embodiments an air release valve such as the valves 124, 416, or 810 may located in a pocket or otherwise secured in a convenient position so a user may activate the valve to vent air from the garment by pressing or squeezing the valve.

In one embodiment, a method of use includes donning an inflatable garment similar to the ones described above and manipulating a pump provided with the garment to pump air into one or more inflatable sections of the garment. When the user wishes to remove the garment, the user may operate an air release valve provided with the garment to release air from the inflatable sections. If the garment is provided with a soft pump, the user may cover an air inlet with the user's finger or in some other way and then squeeze the pump, either by hand or with the user's arm or elbow depending on where in the garment the pump is disposed.

In some embodiments an inflatable cold-weather upper-body garment includes a plurality of interconnected gas flow chambers enclosed by gas-impermeable material within a portion of the garment and soft-sided means such as a soft pump of the kind described above, a squeeze bulb, or other suitable means for inflating the gas flow chambers with air by repeated applications of pressure by a user. The soft-sided means for inflating may be attached to an exterior surface of the garment, for example by being permanently sewn on, or detachably mounted by Velcro, or attached in some other suitable permanent or detachable way. The means for inflating may be disposed within a portion of the garment such as a sleeve or a side of a torso portion of the garment.

The foregoing description and the accompanying drawings illustrate principles of the invention by example but are not to be taken as limiting. The invention is limited only by the claims.

We claim:

1. An inflatable cold-weather upper-body garment comprising:

a torso section with a lowermost end of the garment that defines an opening configured to surround a lower torso of a user, when the garment is worn;

a first plurality of interconnected gas flow chambers enclosed by gas-impermeable material within a left front portion of the upper-body garment;

a second plurality of interconnected gas flow chambers enclosed by gas-impermeable material within a right front portion of the upper-body garment;

a bidirectional gas flow channel disposed in a rear portion of the upper-body garment around a neck opening defined between the left and right front portions of the upper-body garment, the bidirectional gas flow channel connecting the first and second pluralities of gas flow chambers and thereby enabling gas flow (i) from the first plurality of gas flow chambers to the second plurality of gas flow chambers and (ii) from the second plurality of gas flow chambers to the first plurality of gas flow chambers;

a hand-operable air pump in fluid communication with one of the gas flow chambers; and a side pocket sized to contain the hand-operable air pump, the side pocket having an opening through which the hand-operable pump is accessible by the user.

2. The inflatable cold-weather upper-body garment of claim 1 wherein the upper-body garment comprises one of a jacket, a vest, or a shirt and the side pocket is a hand side pocket.

3. The inflatable cold-weather upper-body garment of claim 2 and further comprising a user-operable air release valve in fluid communication with at least one of the first plurality of interconnected gas flow chambers and the second plurality of interconnected gas flow chambers.

4. The inflatable cold-weather upper-body garment of claim 3 wherein the hand-operable air pump comprises a squeeze-bulb pump.

5. The inflatable cold-weather upper-body garment of claim 4 also comprising a zipper for interconnecting the left front section to the right front section.

6. The inflatable cold-weather upper-body garment of claim 4 also comprising an air tube in fluid communication with the at least one of the gas flow chambers and connected to the user-operable air release valve and the hand-operable air pump, the user-operable air tube and release valve being accessible by the user through the opening in the side pocket.

7. The inflatable cold-weather upper-body garment of claim 6 also comprising a zipper for interconnecting the left front section to the right front section.

8. The inflatable cold-weather upper-body garment of claim 3 wherein the hand-operable air pump comprises a flexible gas-impermeable sack having an air outlet and an air inlet.

9. The inflatable cold-weather upper-body garment of claim 8 wherein the air inlet comprises an opening closable by the user when the user compresses the sack.

10. The inflatable cold-weather upper-body garment of claim 9 wherein the opening of the air inlet is closable by pressure of a human finger.

11. The inflatable cold-weather upper-body garment of claim 10 also comprising a zipper for interconnecting the left front section to the right front section.

12. The inflatable cold-weather upper-body garment of claim 10 also comprising an air tube in fluid communication with the at least one of the gas flow chambers and connected to an air release valve and the hand-operable air pump, the air tube and release valve being accessible by the user through the opening in the side pocket.

13. The inflatable cold-weather upper-body garment of claim 9 also comprising a zipper for interconnecting the left front section to the right front section.

14. The inflatable cold-weather upper-body garment of claim 3 also comprising a zipper for interconnecting the left front section to the right front section.

15. The inflatable cold-weather upper-body garment of claim 3 also comprising an air tube in fluid communication with the at least one of the gas flow chambers and connected to an air release valve and the hand-operable air pump, the air tube and release valve being accessible by the user through the opening in the side pocket.

16. The inflatable cold-weather upper-body garment of claim 2 also comprising a zipper for interconnecting the left front section to the right front section.

17. The inflatable cold-weather upper-body garment of claim 2 also comprising an air tube in fluid communication with the at least one of the gas flow chambers and connected to an air release valve and the hand-operable air pump, the air tube and release valve being accessible by the user through the opening in the side pocket.

18. The inflatable cold-weather upper-body garment of claim 1 and further comprising a user-operable air release valve in fluid communication with at least one of the first plurality of interconnected gas flow chambers and the second plurality of interconnected gas flow chambers.

19. The inflatable cold-weather upper-body garment of claim 18 also comprising a zipper for interconnecting the left front section to the right front section.

20. The inflatable cold-weather upper-body garment of claim 18 also comprising an air tube in fluid communication with the at least one of the gas flow chambers and connected to the user-operable air release valve and the hand-operable air pump, the user-operable air tube and user-operable air release valve being accessible by the user through the opening in the side pocket.

21. The inflatable cold-weather upper-body garment of claim 1 wherein the hand-operable air pump comprises a squeeze-bulb pump.

22. The inflatable cold-weather upper-body garment of claim 21 also comprising a zipper for interconnecting the left front section to the right front section.

23. The inflatable cold-weather upper-body garment of claim 21 also comprising an air tube in fluid communication with the at least one of the gas flow chambers and connected to an air release valve and the hand-operable air pump, the air tube and release valve being accessible by the user through the opening in the side pocket.

24. The inflatable cold-weather upper-body garment of claim 1 wherein the hand-operable air pump comprises a flexible gas-impermeable sack having an air outlet and an air inlet.

25. The inflatable cold-weather upper-body garment of claim 24 wherein the air inlet comprises an opening closable by the user when the user compresses the sack.

26. The inflatable cold-weather upper-body garment of claim 25 wherein the opening of the air inlet is closable by pressure of a human finger.

27. The inflatable cold-weather upper-body garment of claim 26 also comprising a zipper for interconnecting the left front section to the right front section.

28. The inflatable cold-weather upper-body garment of claim 25 also comprising a zipper for interconnecting the left front section to the right front section.

29. The inflatable cold-weather upper-body garment of claim 24 also comprising a zipper for interconnecting the left front section to the right front section.

30. The inflatable cold-weather upper-body garment of claim 1 also comprising a zipper for interconnecting the left front section to the right front section.

31. The inflatable cold-weather upper-body garment of claim 30 also comprising an air tube in fluid communication with the at least one of the gas flow chambers and connected to an air release valve and the hand-operable air pump, the air tube and release valve being accessible by the user through the opening in the side pocket.

32. An inflatable cold-weather upper-body garment comprising:

a torso section with a lowermost end of the garment that defines an opening configured to surround a lower torso of a user, when the garment is worn;

a first plurality of interconnected gas flow chambers enclosed by gas-impermeable material within a first portion of the upper-body garment;

a second plurality of interconnected gas flow chambers enclosed by gas-impermeable material within a second portion of the upper-body garment;

a bidirectional gas flow channel connecting the first and second pluralities of gas flow chambers and thereby enabling gas flow (i) from the first plurality of gas flow chambers to the second plurality of gas flow chambers and (ii) from the second plurality of gas flow chambers to the first plurality of gas flow chambers;

a hand-operable air pump in fluid communication with one of the gas flow chambers; and a side pocket sized to contain the hand-operable air pump, the side pocket having an opening through which the hand-operable pump is accessible by the user;

wherein the hand-operable air pump comprises a flexible gas-impermeable sack having an air outlet and an air inlet and a compressible and expandable interior material disposed in the gas-impermeable sack, the interior material having collapsible and expandable cavities through which air may be retained and expelled.

33. The inflatable cold-weather upper-body garment of claim 32 also comprising a zipper for interconnecting the first portion to the second portion of the garment.

34. An inflatable cold-weather upper-body garment comprising:

a first plurality of interconnected gas flow chambers enclosed by gas-impermeable material within a first portion of the garment;

a second plurality of interconnected gas flow chambers enclosed by gas-impermeable material within a second portion of the garment;

a fluid-flow channel connecting the first and second pluralities of gas flow chambers; and a hand-operable air pump in fluid communication with one of the gas flow chambers, the hand-operable air pump comprising a flexible gas-impermeable sack having an air outlet and an air inlet and a compressible and expandable interior material disposed in the sack, the interior material having collapsible and expandable cavities through which air may be retained and expelled, wherein:

the hand-operable air pump is disposed in a sleeve of the garment adjacent an elbow area of the sleeve;

the garment comprising a fabric;

the air outlet comprises an air flow tube extending from the sack through the fabric of the garment to one of the first plurality of interconnected gas flow chambers and the second plurality of interconnected gas flow chambers; and the air inlet comprises a user-accessible opening through the sleeve, whereby a user may compress the pump by arm motion.

35. The inflatable cold-weather upper-body garment of claim 34 also comprising a zipper for interconnecting the first portion to the second portion of the garment.

36. An inflatable cold-weather upper-body garment comprising:

a first plurality of interconnected gas flow chambers enclosed by gas-impermeable material within a first portion of the upper-body garment;

a second plurality of interconnected gas flow chambers enclosed by gas-impermeable material within a second portion of the upper-body garment;

a fluid-flow channel connecting the first and second pluralities of gas flow chambers and thereby enabling fluid flow (i) from the first plurality of gas flow chambers to the second plurality of gas flow chambers and (ii) from the second plurality of gas flow chambers to the first plurality of gas flow chambers; and a hand-operable air pump in fluid communication with one of the gas flow chambers, the hand-operable air pump comprising a flexible gas-impermeable sack having an air outlet and an air inlet and a compressible and expandable interior material disposed in the gas-permeable sack, the interior material having collapsible and expandable cavities through which air may be retained and expelled, wherein:

the hand-operable air pump is disposed in one of the first plurality of interconnected gas flow chambers and the second plurality of interconnected gas flow chambers;

the air outlet comprises an opening in the gas-permeable sack; and the air inlet comprises a user-accessible opening in the upper-body garment;

whereby a user may close the air inlet and compress the hand-operable pump by motion of one of an arm and a hand.

37. The inflatable cold-weather upper-body garment of claim 36 also comprising a zipper for interconnecting the first portion to the second portion of the garment.

38. An inflatable cold-weather upper-body garment comprising:

a torso section with a lowermost end of the garment that defines an opening configured to surround a lower torso of a user, when the garment is worn;

a first plurality of interconnected gas flow chambers enclosed by gas-impermeable material within a first portion of the upper-body garment;

a second plurality of interconnected gas flow chambers enclosed by gas-impermeable material within a second portion of the upper-body garment;

a bidirectional fluid-flow channel connecting the first and second pluralities of gas flow chambers and thereby enabling fluid flow (i) from the first plurality of gas flow chambers to the second plurality of gas flow chambers and (ii) from the second plurality of gas flow chambers to the first plurality of gas flow chambers; and a hand-operable air pump in fluid communication with one of the gas flow chambers, the hand-operable air pump comprising a flexible gas-impermeable sack having an air outlet and an air inlet and a compressible and expandable interior material disposed in the gas-impermeable sack, the interior material having collapsible and expandable cavities through which air may be retained and expelled, the garment comprising a fabric;

wherein the hand-operable air pump is disposed in the fabric of the garment adjacent one of the first plurality of interconnected gas flow chambers and the second plurality of interconnected gas flow chambers and the air inlet comprises a user-accessible opening in the garment.

39. The inflatable cold-weather upper-body garment of claim 38 also comprising a zipper for interconnecting the first portion to the second portion of the garment.

* * * * *